United States Patent [19]

Caenazzo et al.

[11] Patent Number: 4,885,978

[45] Date of Patent: Dec. 12, 1989

[54] FLUID-OPERATED MINIATURE ENGINE

[76] Inventors: Alessandro Caenazzo; Silvana Pasqualotto, both of San Vendemiano, Italy

[21] Appl. No.: 187,012

[22] Filed: Apr. 27, 1988

[30] Foreign Application Priority Data

May 7, 1987 [IT] Italy ..... 83370 A/87

[51] Int. Cl.[4] ..... F15B 15/22

[52] U.S. Cl. ..... 91/232; 91/276; 91/325; 91/394; 91/402; 91/404; 91/410; 92/249

[58] Field of Search ..... 91/400, 401, 402, 404, 91/410, 218, 232, 276, 321, 325, 394; 92/249, 250; 417/489

[56] References Cited

U.S. PATENT DOCUMENTS

| | | | |
|---|---|---|---|
| 1,203,018 | 10/1916 | Larson | 91/325 X |
| 1,266,252 | 5/1918 | Hadford . | |
| 2,299,879 | 10/1942 | Court . | |
| 2,588,478 | 11/1946 | Brown et al. . | |
| 2,792,170 | 5/1957 | Hudson et al. . | |
| 3,473,329 | 10/1969 | Eggstein . | |
| 3,703,848 | 11/1972 | Brown . | |
| 3,910,160 | 10/1975 | Divine . | |
| 3,995,535 | 12/1976 | Ozechowski . | |
| 4,047,854 | 9/1977 | Penn | 417/489 |
| 4,050,357 | 9/1977 | Carter et al. | 91/410 |
| 4,190,024 | 2/1980 | Davis . | |
| 4,766,802 | 8/1988 | Caenazzo et al. . | |
| 4,781,544 | 11/1988 | Leonard et al. | 417/392 |

FOREIGN PATENT DOCUMENTS

| | | |
|---|---|---|
| 0151314 | 8/1985 | European Pat. Off. . |
| 0244813 | 4/1911 | Fed. Rep. of Germany . |
| 2024427 | 12/1971 | Fed. Rep. of Germany . |
| 2912556 | 2/1980 | Fed. Rep. of Germany . |
| 0355350 | 10/1928 | France . |
| 83338-A/86 | 9/1987 | Italy . |
| 2018366 | 10/1979 | United Kingdom . |
| 2029908 | 3/1980 | United Kingdom . |

*Primary Examiner*—Edward K. Look

*Attorney, Agent, or Firm*—Wegner & Bretschneider

[57] ABSTRACT

Miniature engine operated by an expanding gaseous fluid, which comprises a cylinder (18), piston (20) and inlet valve (29), the upper part of the piston (20) cooperating with a radially expansible resilient diaphragm (28), which is secured to the piston (20) and performs momentarily a pneumatic seal-engagement function along the periphery of said cylinder (18) during the gaseous expansion phase.

20 Claims, 6 Drawing Sheets

FLUID-OPERATED MINIATURE ENGINE

This invention concerns a fluid-operated miniature engine; more precisely it concerns a miniature engine suitable to be actuated by the energy of a gaseous fluid under pressure such as air, carbon dioxide, Freon or another gas which can be employed for the purpose.

A miniature engine of this type is properly employed with models for the movement of toys, dynamic models, small mechanisms, small tools, fans, etc.

For the movement of models, toys, etc. of the above type it is the normal practice to use small internal-combustion engines, small electric motors, small motors operated by spring or elastic band and also small or miniature fluid-operated engines.

Document EP-A-No. 0,151,314 discloses a device provided with a piston which is movable within a cylinder. Said piston operates on a connecting rod-crank assembly. The axis of the crank is connected, for instance, to the propeller of a model-airplane. The device is further provided with a gas inlet valve, which may be closed by means of a ball, on which a protuberance of the piston acts.

GB-A-No. 2,029,908 discloses a fluid-operated miniature motor which uses a complex structure so as to be able to perform all the functions needed for its operation with an acceptable efficiency at an acceptable cost.

U.S. Pat. Nos. 2,588,478 and 3,703,848 disclose very simplified fluid-operated miniature engines the efficiency of which is inadequate for their employment. These engines have to be fed with high pressure fluids which are hard to transport and handle and besides are dangerous.

DE-A-No. 2.912.556 discloses substantially a miniature engine of the same type as those of the above two U.S. patents. This patent is the same as GB-A-No. 2,018,366 and provides for the exhaust valve to be actuated by a prong jutting out from the crown of the piston.

The known engines have their feeder valve operated by a prong on the piston. Moreover, they do not provide for an exhaust valve apart from lateral holes at the end of the stroke of the piston.

All the known fluid-operated miniature engines entail inadequate efficiency and high production costs since, in view of the measurements involved, which are very small and amount only to millimeters, the working tolerances have to be very small, and this is hard to accomplish, above all in mass production.

Furthermore, if the fluid-operated miniature engines of a known type are to maintain their efficiency on the assumption that the production tolerances are the right ones, they have to comprise a plurality of parts made of hard and costly materials, which require lubrication to prevent such tolerances being affected by wear and the efficiency being speedily lost.

Otherwise the known miniature engines require resilient seal-engagement packings which cause great wear between piston and cylinder to the detriment of the efficiency.

BE-C-355.350 discloses an engine operated by a fluid under pressure, the engine comprising an exhaust valve actuated by the piston itself by means of a plunger lodged in the piston, thus entailing great complications in fabrication and operation.

U.S. Pat. No. 3,910,160 too employs exhaust valves actuated by plungers governed by the head of the connecting rod; this embodiment involves not only great constructional complications but also dimensions such as make necessary a piston displacement of a considerable value.

U.S. Pat. No. 4,190,024 discloses a Diesel engine with an exhaust slit of the type traditional in two-stroke engines.

This invention therefore provides a fluid-operated miniature engine of the same type as that of U.S. Pat. No. 2,588,478 but suitable to work mainly at medium-low pressures without particular lubrication problems and to be realised with inexpensive materials such as plastics, for instance.

The invention also provides a miniature engine the components of which can be made by moulding or other systems compatible with mass production without problems of accurate, limited tolerances.

The invention therefore has the purpose also of obtaining components having relatively wide working and fit tolerances.

This is achieved by a miniature engine having the features disclosed in claim 1.

According to the invention a resilient diaphragm solidly fixed to the upper crown of the piston is made to cooperate with the upper part of the expansion cylinder. This diaphragm performs a pneumatic seal-engagement function in relation to the expanding fluid during at least part of the fluid expansion phase, thus reducing consumption considerably.

According to a form of embodiment the chamber to store the fluid under pressure can cooperate with a valve actuated, for instance, by the piston itself so as to maximize the effect of the fluid under pressure.

According to a further form of embodiment the crankshaft cooperates with an eccentric support able to obtain required timing in relation to the top dead centre point of the piston.

According to another embodiment the outlets for the expanded fluid at the end of the piston stroke can be obtained with appropriate radial slits machined along the length of the piston, these slits becoming uncovered at a suitable moment by the return of the resilient diaphragm to its relaxed position.

According to another form of embodiment a device is provided which can govern the opening and closure of the fluid inlet valve in relation to the top dead centre point of the piston.

The attached figures, which are given as a non-restrictive example, show the following:

Figure 1:
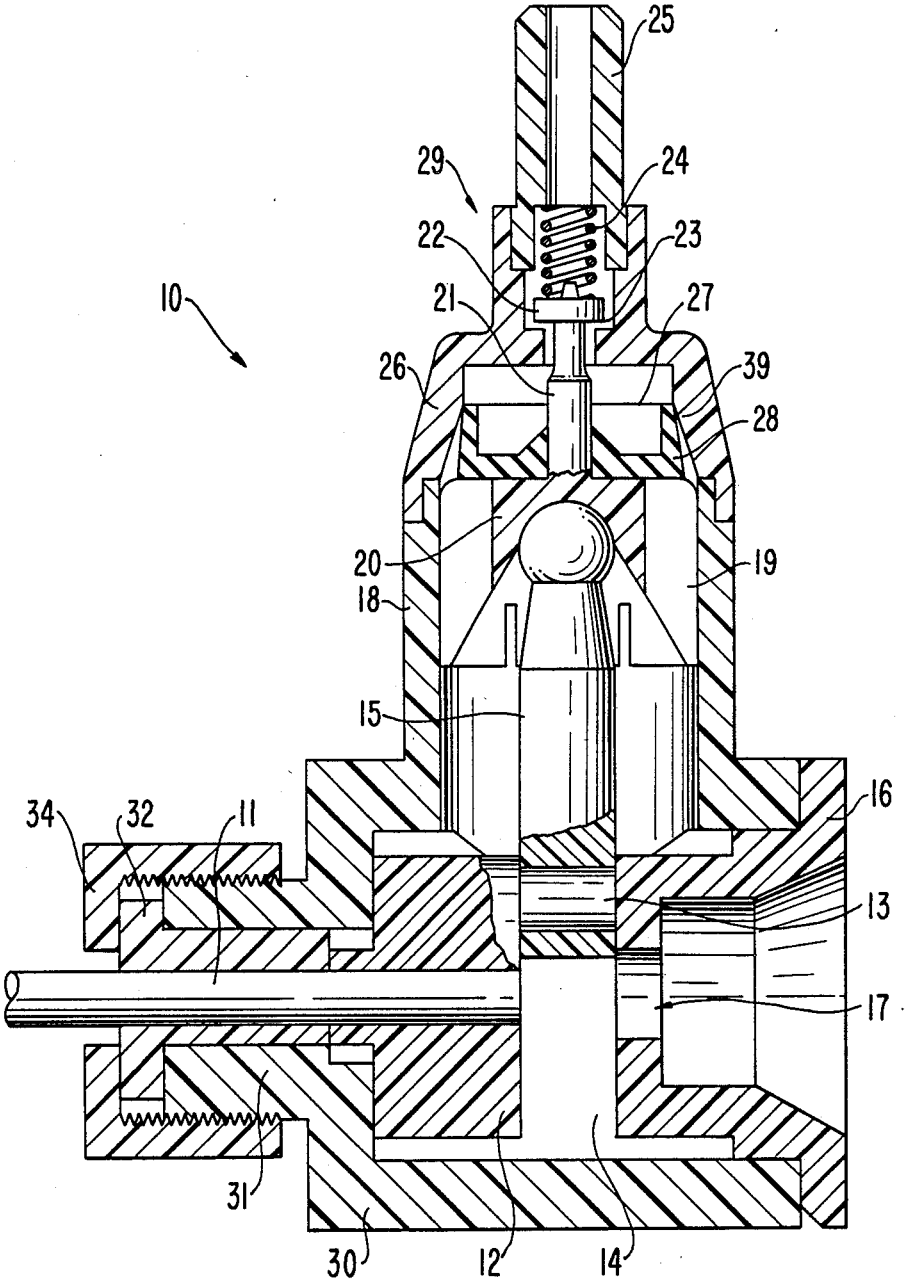
FIG. 1 shows a lengthwise vertical section of a preferred miniature engine according to the invention.

A miniature engine 10 according to the above figures comprises components made of a moulded plastic except a shaft 11 and spring 24 consisting of a metal in this case and a diaphragm 28 made of soft rubber, in this instance a silicone rubber, rubber latex or natural rubber or another material possessing great resilience.

To indicate the dimensions involved and the resulting constructional and operational problems which led to the embodiments of the invention, it may be noted that a piston 20 of the miniature engine can have a bore ranging from 4 up to 12–20 mm.

A base 30 supports a crankshaft 11 and contains in a casing 14 a flywheel 12 solidly fixed to the crankshaft 11 and performing the function of a crank.

The flywheel 12 comprises a pivot 13 to which a connecting rod 15 is rotatably fitted. The casing 14 is closed with a cover 16 which may include an exhaust hole 17. The piston 20 slides in a cylinder 18.

The piston 20 comprises radially arranged lengthwise grooves 19, which connect the crown of the piston 20 to the casing 14 and exhaust hole 17.

A cylinder head 26 cooperates with the base 30 in the upper part of the engine. Mechanical fixture connection of the base 30 to the cylinder head 26 can be obtained in any known manner.

In the example shown a diaphragm 28 is secured in cooperation with the upper part of the cylinder 18. The diaphragm 28 can normally have a cup-shaped conformation (FIGS. 1 and 4) or the conformation of a toric omega (FIGS. 2, 3 and 5) or a toric "V" (FIGS. 6 to 10).

All the conformations of the diaphragm 28 posses a feature arising from the soft, resilient material of which the diaphragm consists, namely a feature according to which, when there is pressure in an expansion chamber 27, the diaphragm 28 expands radially and fits against the inner circumferential wall of the cylinder 18 and rests on a crown 120 of the piston 20.

In FIGS. 1 to 5 the diaphragm is squashed against the circumferential wall of the cylinder 18 by the pressure of the liquid, whereas in FIGS. 6 to 10 the diaphragm is squashed first of all against the circumferential wall of the cylinder 18 and against the upper crown 120 of the piston 20 by the conformation of the upper crown 126 of the cylinder 18, while thereafter it is the pressure of the fluid which keeps it in that position until the expanding pressure in the expansion chamber 27 becomes equal to the thrust of the diaphragm, which then takes up again its original shape. As the piston 20 descends inside the cylinder 18, the pressure in the expansion chamber 27 is reduced.

While the piston 20 continues its downstroke and the expansion chamber 27 is lengthened, there is a moment when the resilient force of return to its original position possessed by the diaphragm 28 becomes greater than the pressure of the fluid then held in the expansion chamber 27 as then constituted.

In such a situation the diaphragm 28 takes up its original conformation once again and opens a toric ring of communication between the expansion chamber 27 and the casing 14 through grooves 19.

When the toric ring of communication is obtained about the diaphragm 28, which has again taken up its original conformation, the pressure in the expansion chamber 27 quickly becomes equal to the atmospheric pressure and thus enables the piston 20 to rise without encountering opposed pressures.

The diaphragm 28 is made of a resilient material such as a soft rubber, for instance silicone rubber, rubber latex or natural sheet rubber or any other material possessing a great capacity of expansion in a substantially or wholly resilient field.

Figure 5:
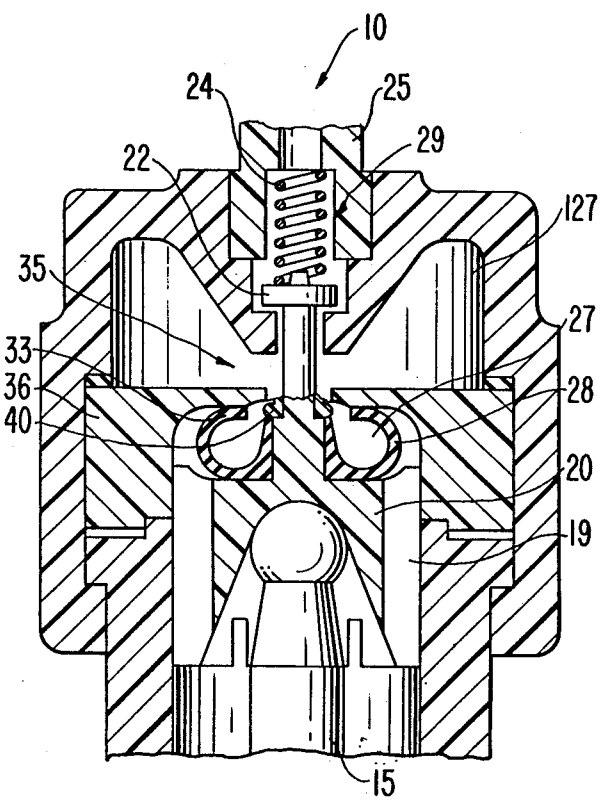
FIGS. 4 and 5 show further variants.
Figure 4:
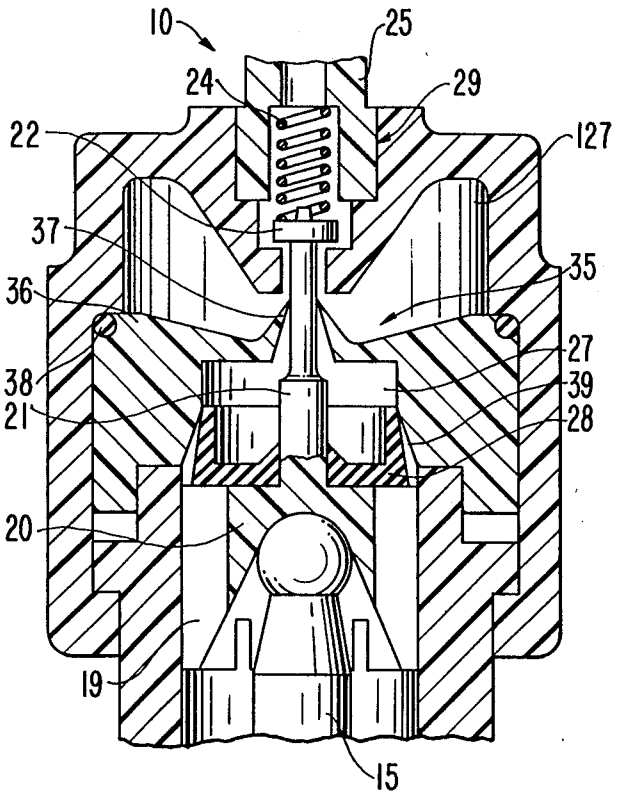
Figure 7:
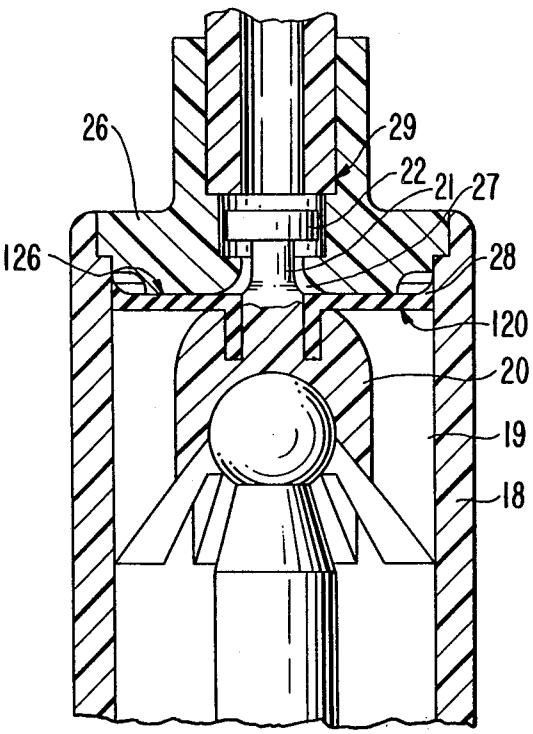
FIGS. 6 and 7 show a variant of the diaphragm of FIG. 1.
Figure 6:
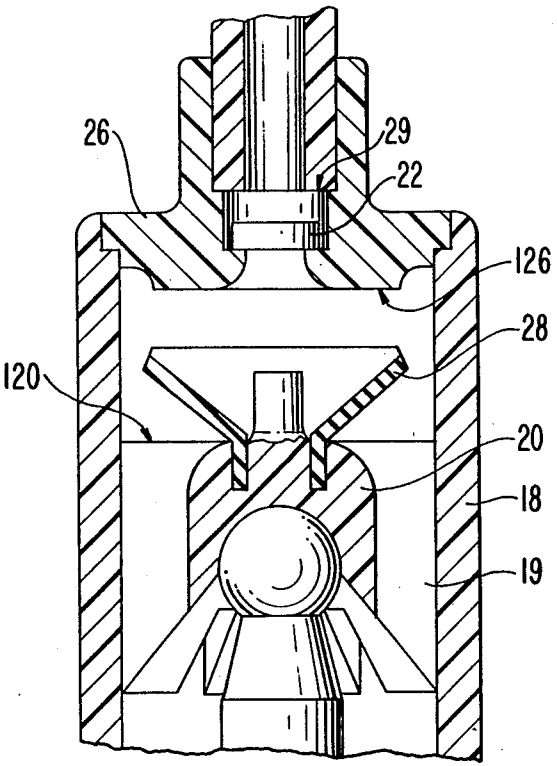

The expansion chamber 27 and, in the case of FIGS. 4 and 5, the storage chamber 127 are positioned above the diaphragm 28.

The cylinder head 26 includes an inlet valve 29, which in this case is actuated by a push rod 21 located on the piston 20 at about the top dead centre point of the piston. This valve 29 can also be positioned elsewhere and be actuated otherwise.

In the example shown the inlet valve 29 is opened by the push rod 21 when the latter overcomes the thrust of a spring 24 and displaces a small disk 22 or ball or other suitable means from a seating 23.

Figure 10:
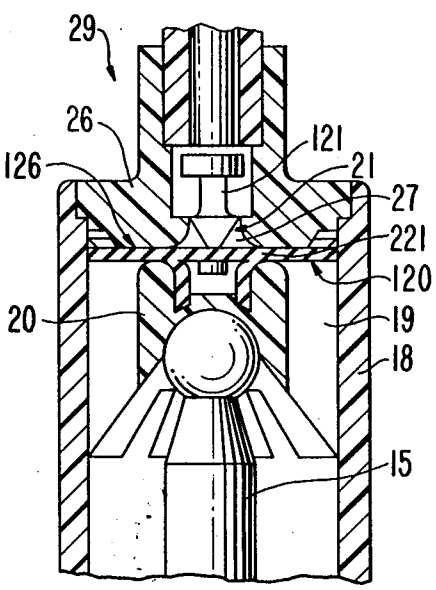
FIGS. 8, 9 and 10 show variants of devices that open and close the inlet valve in relation to the top dead centre position of the piston.
Figure 9:
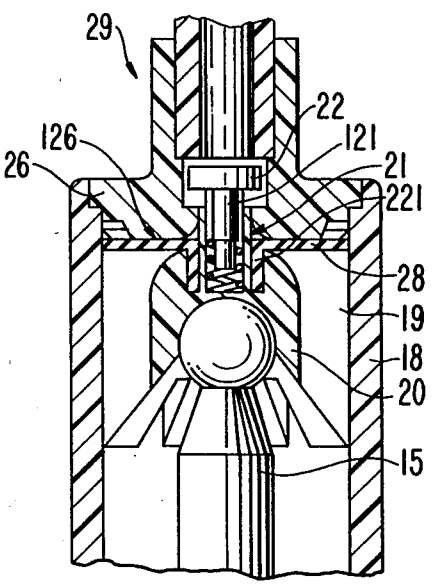
Figure 8:
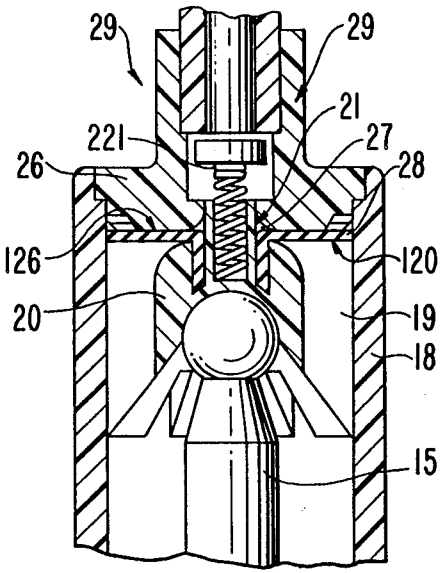

The variants of FIGS. 8 to 10 provide a device suitable to govern the opening and closure of the inlet valve 29 in a required manner and at the desired times in relation to the top dead centre point of the piston 20.

The operation of the device is based on the following principle.

Since there is pressure in the chamber above the small disk 22, the latter 22 opens at once when the push rod 21 acts on the small disk 22 or ball or other suitable element.

But if the push rod 21 comprises a resilient element 221 which enables the piston 20 to continue rising without the small disk 22 having to move at once, then the opening of the valve 29 is retarded and its closure is also retarded since the resilient yielding of the resilient element 221 has to be taken up.

The delay in such opening depends on the correlation between the properties of the resilient element 221 and the feed pressure of the fluid; the less the resilient element 221 is pre-loaded before opening the inlet valve 29, the sooner that valve is opened.

FIG. 8 provides for the resilient element 221 to act directly on the disk or other element 22 that closes the inlet valve.

FIG. 9 provides for the resilient element 221 to act through a pin 121, whereas in FIG. 10 the pin 121 is anchored to an extension of the diaphragm 28, such extension thus constituting the resilient element 221.

The method of working is the following. When the inlet valve 29 is open, the fluid under pressure expands in the storage chamber 27, which is sealed since the diaphragm 28 rests in seal-engagement on the inner circumferential wall of the cylinder 18.

As the crankshaft 11 continues its rotation, the piston 20 descends, and this downstroke is assisted by expansion of the fluid under pressure in the expansion chamber 27 forming in the cylinder 18.

The piston 20 descends; when equilibrium is reached between the pressure of the fluid and the resilience of the material of which the diaphragm 28 consists, the diaphragm detaches itself from the circumferential wall of the cylinder 18 and frees a toric space that communicates with exhaust passages consisting of the grooves 19 in the piston.

As the gas pours out through the grooves 19 in the piston 20, the pressure in the expansion chamber 27 drops substantially to zero.

As a result, the ipstroke of the piston 20 is facilitated since the expansion chamber 27 is now at the environmental pressure.

According to the invention a support 31 is provided in cooperation with the base 30 and comprises a hole with which an eccentric bearing 32 cooperates.

A splined coupling may be provided between the front part of the eccentric bearing 32 and the front part of the support 31 so as to maintain the required, reciprocal, radial positioning of the support 31 and eccentric bearing 32. A clamping plug 34 may be included.

By means of this system it is possible to determine accurately the top dead centre point of the piston 20 and thus to obtain correct timing.

The diaphragms 28 are shown in the figures. The diaphragm 28 of FIGS. 1 and 4 cooperates at the top dead centre point with a tapered wall 39 of the cylinder 18, thus enabling the expansion chamber 27 to be pressurized.

Instead of the tapered wall 39, FIGS. 6 to 10 show the diaphragm 28 thrust until it touches the crown 126 of the expansion chamber 27, thus creating a required hermetic seal and a mechanical deformation of the diaphragm 28 that causes a pneumatic seal.

Figure 2:
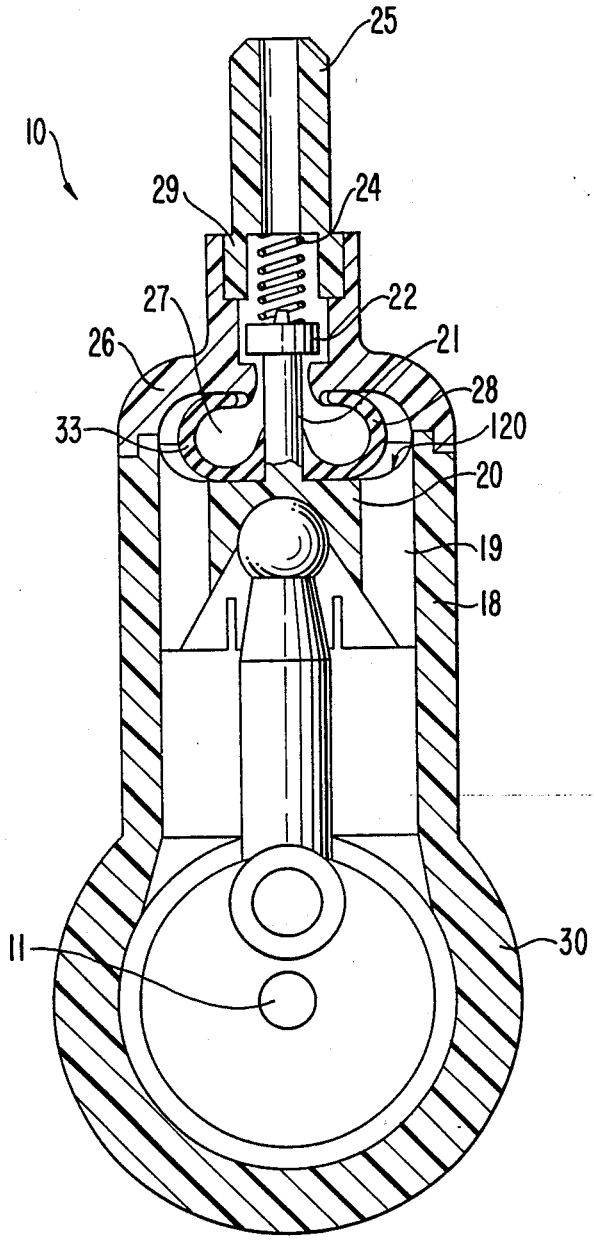
FIGS. 2 and 3 show, in a variant of the miniature engine of FIG. 1, a vertical section at a right angle to the section of FIG. 1.
Figure 3:
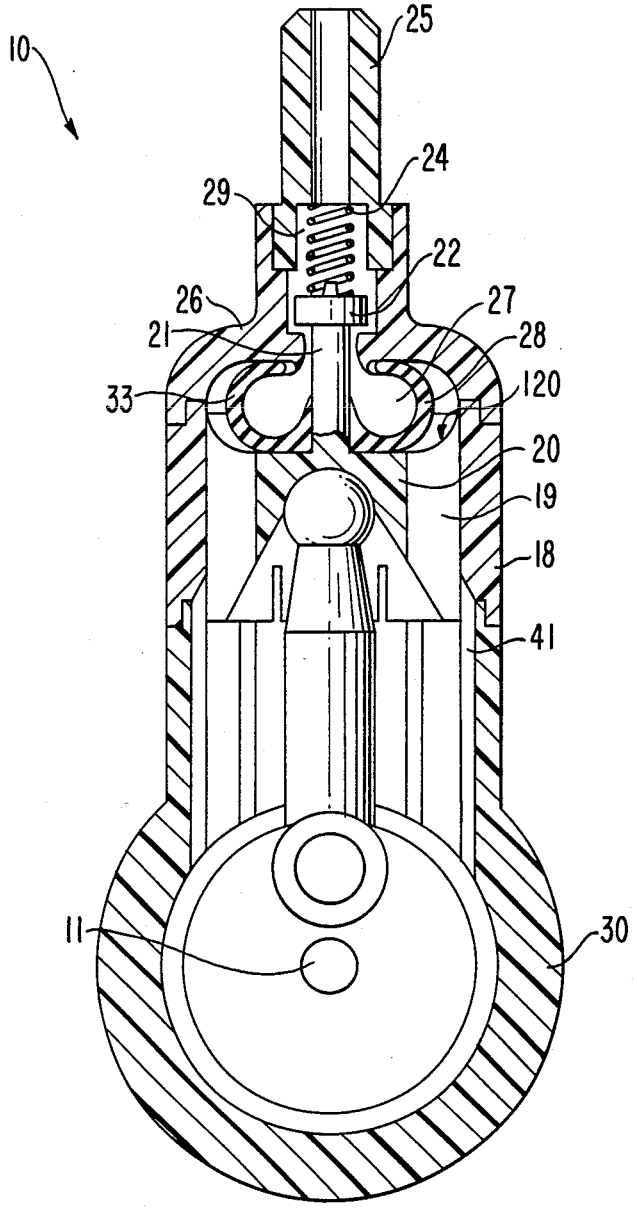

The embodiment of FIGS. 2, 3 and 5 forms a variant of such second embodiment and comprises a diaphragm 28 conformed as a toric omega and rested against the crown of the expansion chamber 27 to create a seal-engagement therewith. The omega-shaped conformation of its ears 33 enables the diaphragm to be easily deformed radially.

The upper head 120 of the piston 20 can be conformed as a support cradle, and the upper crown of the expansion chamber 27 may be suitably rounded to facilitate the sliding of the ears 33 in maintaining a seal-engagement.

According to the form of embodiment of FIG. 3 and enlargement 41 in the cylinder in correspondence with the bottom dead centre point of the piston 20 facilitates the return of the diaphragm 28 to its normal position.

According to another form of embodiment (FIGS. 4 and 5) an intermediate valve 35 may be provided and serves to keep the fluid under pressure in the storage chamber 127 for a period long enough for the piston 20 to pass its top dead centre point and for the expansion of the fluid to take place only during the downstroke of the piston and therefore when such expansion is of assistance.

Such valve 35 can be arranged in various ways. FIG. 4 provides a support disk 36 with a sealing ring 38. The support disk 36 comprises at its centre in cooperation with the push rod 21 a hollow cone 37, which closes or substantially reduces the passage of fluid around the push rod 21 while the push rod is cooperating with the top end of the hollow cone 37.

In FIG. 5 the support disk 36 cooperates with a ring 40 made of a soft, resilient material and positioned on the push rod 21. While the ring 40 is acting on the central hole of the support disk 36, a seal-engagement is obtained.

It can be seen from the above that, in contrast to the known art of miniature engines, the miniature engine of this invention has an exhaust valve open throughout the whole period of the upstroke of the piston 20, and therefore owing to the elimination of compression during the upstroke the efficiency of this engine is better than that of the types known in the art.

We claim:

1. A miniature engine operated by an expanding gaseous fluid, comprising a cylinder having an inner circumferential wall, an inlet valve which opens so as to let the gaseous fluid into the cylinder, and a piston movable within said cylinder, said piston descending during expansion of the gaseous fluid and then ascending, wherein said piston comprises a radially expansible resilient diaphragm attached to an upper portion thereof, said resilient diaphragm contacting the inner circumferential wall of the cylinder during descent of the piston so as to form a pneumatic seal, but not contacting the inner circumferential wall of the cylinder during at least a portion of ascent of the piston.

2. The miniature engine as claimed in claim 1, wherein said resilient diaphragm applies a pressure against the inner circumferential wall of the piston which progressively decreases during descent of the piston.

3. The miniature engine as claimed in claim 1, further comprising exhaust means for exhausting the gaseous fluid from the cylinder, wherein said exhaust means is momentarily blocked by the resilient diaphragm during descent of the piston.

4. The miniature engine as claimed in claim 1, wherein said cylinder has an upper crown, said resilient diaphragm assumes an inactive position during ascent of the piston, and said resilient diaphragm has a shape of a bell facing the upper crown of the cylinder when in the inactive position, wherein when the piston has ascended to an uppermost position the resilient diaphragm does not contact the circumferential side wall of the cylinder, but contacts the upper crown of the cylinder so as to form a pneumatic seal.

5. The miniature engine as claimed in claim 1, wherein said piston descends to a lowermost position, said cylinder comprising an exhausting enlargement located near said lowermost position.

6. The miniature engine as claimed in claim 1, wherein said cylinder has an upper crown, said resilient diaphragm assumes an inactive position during ascent of the piston, and said resilient diaphragm has a shape of a toric omega facing the upper crown of the cylinder when in the inactive position, wherein when the piston has ascended to an uppermost position the resilient diaphragm does not contact the circumferential side wall of the cylinder, but contacts the upper crown of the cylinder so as to form a pneumatic seal.

7. The miniature engine as claimed in claim 1, wherein said cylinder has an upper crown which has a deformation located therein, said resilient diaphragm assumes an inactive position during ascent of the piston, and said resilient diaphragm has a shape of a toric "V" facing the upper crown of the cylinder when in the inactive position, wherein when the piston has ascended to an uppermost position the resilient diaphragm does not contact the circumferential side wall of the cylinder, but contacts the deformation located in the upper crown of the cylinder so as to form a pneumatic seal.

8. The miniature engine as claimed in claim 1, wherein said piston ascends to an uppermost position and said cylinder defines an expansion chamber and a storage chamber, said engine further comprising an intermediate valve which closes before the inlet valve opens and which opens after the piston has begun to descend from the uppermost position.

9. The miniature engine as claimed in claim 8, further comprising a push rod which projects from the upper portion of the piston, wherein said push rod momentarily closes said intermediate valve.

10. The miniature engine as claimed in claim 1, further comprising means for retarding opening of said inlet valve attached to the upper portion of the piston.

11. The miniature engine as claimed in claim 10, further comprising a body which opens said inlet valve, wherein said retarding means is a resilient element which cooperates with said body.

12. The miniature engine as claimed in claim 11, wherein said resilient element is a spring.

13. The miniature engine as claimed in claim 11, wherein said resilient element is a resilient diaphragm.

14. The miniature engine as claimed in claim 11, wherein said resilient element cooperates with a pin.

15. A miniature engine operated by an expanding gaseous fluid, comprising a cylinder having an inner circumferential wall, an inlet valve which opens so as to let the gaseous fluid into the cylinder, and a piston movable within said cylinder, said piston descending during expansion of the gaseous fluid and then ascending, wherein said piston comprises a radially expansible resilient diaphragm attached to an upper portion thereof, said resilient diaphragm contacting the inner circumferential wall of the cylinder during descent of the piston so as to form a pneumatic seal, but not contacting the inner circumferential wall of the cylinder during at least a portion of ascent of the piston, said cylinder having at least one groove located in the inner circumferential wall thereof, said at least one radial groove being blocked by the resilient diaphragm during descent of the piston.

16. The miniature engine as claimed in claim 15, wherein said resilient diaphragm applies a pressure against the circumferential inner wall of the piston which progressively decreases during descent of the piston.

17. The miniature engine as claimed in claim 15, wherein said cylinder has an upper crown, said resilient diaphragm assumes an inactive position during ascent of the piston, and said resilient diaphragm has a shape of a bell facing the upper crown of the cylinder when in the inactive position, wherein when the piston has ascended to an uppermost position the resilient diaphragm does not contact the circumferential side wall of the cylinder, but contacts the upper crown of the cylinder so as to form a pneumatic seal.

18. A miniature engine operated by an expanding gaseous fluid, comprising a cylinder having an inner circumferential wall having a tapered portion, an inlet valve which opens so as to let the gaseous fluid into the cylinder, and a piston movable within said cylinder, said piston descending during expansion of the gaseous fluid and then ascending, wherein said piston comprises a radially expansible resilient diaphragm attached to an upper portion thereof, said resilient diaphragm contacting the inner circumferential wall of the cylinder during descent of the piston so as to form a pneumatic seal, but not contacting the inner circumferential wall of the cylinder during at least a portion of ascent of the piston, and wherein said resilient diaphragm is shaped as a cup and when the piston ascends to near an uppermost position, the resilient diaphragm cooperates with the tapered portion of the inner circumferential wall of the cylinder so as to form a pneumatic seal.

19. The miniature engine as claimed in claim 18, wherein said resilient diaphragm applies a pressure against the circumferential inner wall of the piston which progressively decreases during descent of the piston.

20. The miniature engine as claimed in claim 18, wherein said cylinder has at least one groove located in the inner circumferential wall thereof, said at least one radial groove being blocked by the resilient diaphragm during descent of the piston.

* * * * *